United States Patent [19]

Eddy

[11] 3,942,414

[45] Mar. 9, 1976

[54] HYDRAULIC DEVICE

[75] Inventor: Robert T. Eddy, South Bend, Ind.

[73] Assignee: Reliance Electric Company, Mishawaka, Ind.

[22] Filed: May 31, 1973

[21] Appl. No.: 365,578

Related U.S. Application Data

[63] Continuation of Ser. No. 876,543, Nov. 13, 1969, abandoned.

[52] U.S. Cl. ..... 91/487; 91/491

[51] Int. Cl. ..... F01b 13/06

[58] Field of Search ..... 91/472, 485, 487, 488, 91/491, 498

[56] References Cited

UNITED STATES PATENTS

| | | | |
|---|---|---|---|
| 1,325,434 | 12/1919 | Carry | 91/472 |
| 2,101,829 | 12/1937 | Benedek | 91/498 |
| 2,712,794 | 7/1955 | Humphreys | 91/485 |
| 2,882,831 | 4/1969 | Dawneuig | 91/498 |
| 3,078,808 | 2/1963 | Byers, Jr. | 91/491 |
| 3,086,477 | 4/1963 | Ruhl | 91/487 |
| 3,122,971 | 3/1964 | Russell | 91/485 |
| 3,587,402 | 6/1971 | Schluter | 91/498 |
| 3,699,848 | 10/1972 | Prendergast | 91/487 |

FOREIGN PATENTS OR APPLICATIONS

| | | | |
|---|---|---|---|
| 964,944 | 7/1964 | United Kingdom | 91/491 |
| 120,773 | 11/1918 | United Kingdom | 91/497 |

*Primary Examiner*—William L. Freeh
*Attorney, Agent, or Firm*—Marmaduke Hobbs

[57] ABSTRACT

A hydraulic device which is primarily intended for use as a motor, includes an annular stator having an internal cam surface consisting of a plurality of outwardly and inwardly extending reaction surfaces, and a rotor disposed within said stator having a plurality of open-ended fluid pressure chambers with a rolling element therein engaging the outwardly and inwardly extending reaction surfaces and extending the width of the rotor. The rotor is mounted on a shaft and when operating as a motor is rotated by the rolling elements reacting on the outwardly extending reaction surfaces to rotate the shaft. Fluid inlet and outlet passages are disposed in a port plate disposed along the side of the rotor and communicate with the fluid pressure chambers through one of their open ends.

12 Claims, 4 Drawing Figures

HYDRAULIC DEVICE

This application is a continuation of my copending application Serial No. 876,543 filed November 13, 1969 now abandoned. The conventional vane and gear type hydraulic motors and gerotor motors are extensively used in hydraulic power transmission systems and will perform satisfactorily under normal operating conditions and will have a reasonably long operating life at low and moderate hydraulic pressures. However, at relatively high pressures these motors frequently have only a limited life, and their efficiency is often impaired within a relatively short time at the higher pressures. The parts of these conventional motors often are subjected to excessive wear at normal pressures, and in order to obtain the required operating efficiency, relatively close tolerance must be maintained during fabrication of the motor parts. Further, under certain conditions of operation, such as when the motor is being driven by the equipment normally driven by the motor, cavitation may occur in the hydraulic system anterior to the motor, which may place an undue burden on the equipment and system or render the system inoperative. It is therefore one of the principal objects of the present invention to provide a hydraulic motor which can be operated efficiently under high pressure and at high torque for extended periods of time without failure, and which is so constructed and designed that the parts thereof have a long life throughout the normal pressure operating range.

Another object of the invention is to provide a motor having a plurality of reaction elements, which will not become pumping elements in the event the equipment, normally driven by the motor, drives the motor, and which hence will not cause cavitation in the hydraulic lines of the system, but rather becomes free wheeling whenever the foregoing condition develops in the motor-equipment installation, thus minimizing the braking action of the motor during such operating conditions.

Still another object is to provide a relatively simple, compact and versatile hydraulic motor having a series of reciprocating elements forming a pressure responsive means in individual chambers, which have a wear compensating and fluid sealing structure, for increasing the operating efficiency and extending the effective life of the elements, and which is easily serviced and repaired to maintain the motor in optimum operating condition.

A further object is to provide a motor of the aforementioned type having a stator and a rotor in which the rotor and the output shaft therefor are hydraulically balanced.

Additional objects and advantages of the invention will become apparent from the following description and accompanying drawings, wherein.

Figure 1:
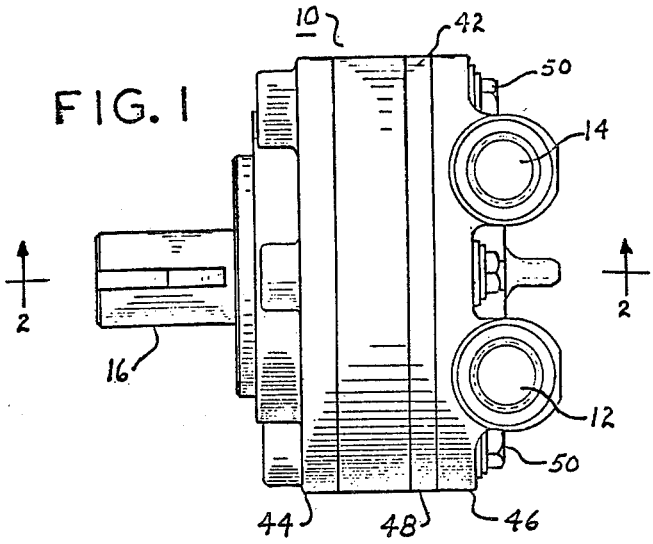
FIG. 1 is an elevational view of the present hydraulic motor.

Referring more specifically to the drawings, numeral 10 indicates generally the present hydraulic motor having fluid inlet passage 12, fluid outlet passage 14, and power output shaft 16. While the description is directed to the present device as a hydraulic motor, it may be used as a hydraulic pump if desired, with few or no changes in the basic structure thereof; however, the description herein will be directed primarily to the use of the device as a hydraulic motor. The system in which the motor is used normally includes a hydraulic pump for providing the necessary hydraulic pressure through a line from its pump to inlet 12 and a return line connected to outlet 14. The system, including the pump which is normally driven by an electrical motor or an engine and the motor, may be used to drive a variety of different types of machines or equipment, connected to shaft 16 of the motor.

The motor 10 consists of a rotor 20 having a plurality of fluid chambers 22 and rolling elements 24 in the fluid chambers operating in effect as pistons. The rotor is mounted on output shaft 16 and secured there by key 26 disposed in key-ways 28 and 30 in the rotor and shaft, respectively. The rotor is disposed in a stationary stator 40 or reaction member, the external part of which forms the periphery of housing 42 which includes end sections 44 and 46 and intermediate section or port ring 48. The four sections 40, 44, 46, and 48 are secured together to form a rigid housing structure by a plurality of bolts 50 extending through holes in the sections and being threadedly received in holes 52 in section 44, and the sections are preferably sealed by gaskets such as O-ring 49. Shaft 16 is journaled in bearings 54 and 56 disposed in annular recesses on the internal face of sections 44 and 46, the shaft being sealed by an annular seal 58 in the enlarged opening 60 through the end section 44 in which the shaft rotates. The shaft is held against end-wise axial movement by a collar 62 engaging bearing 54 and shoulder 64 engaging bearing 56. The outer end of shaft 16 is provided with a key and key-way in order to connect the shaft to the driven mechanism or equipment. A sheave, gear, or other drive transmission element may be mounted on the shaft, or the shaft may be coupled directly to the input shaft of the driven equipment.

Figure 2:
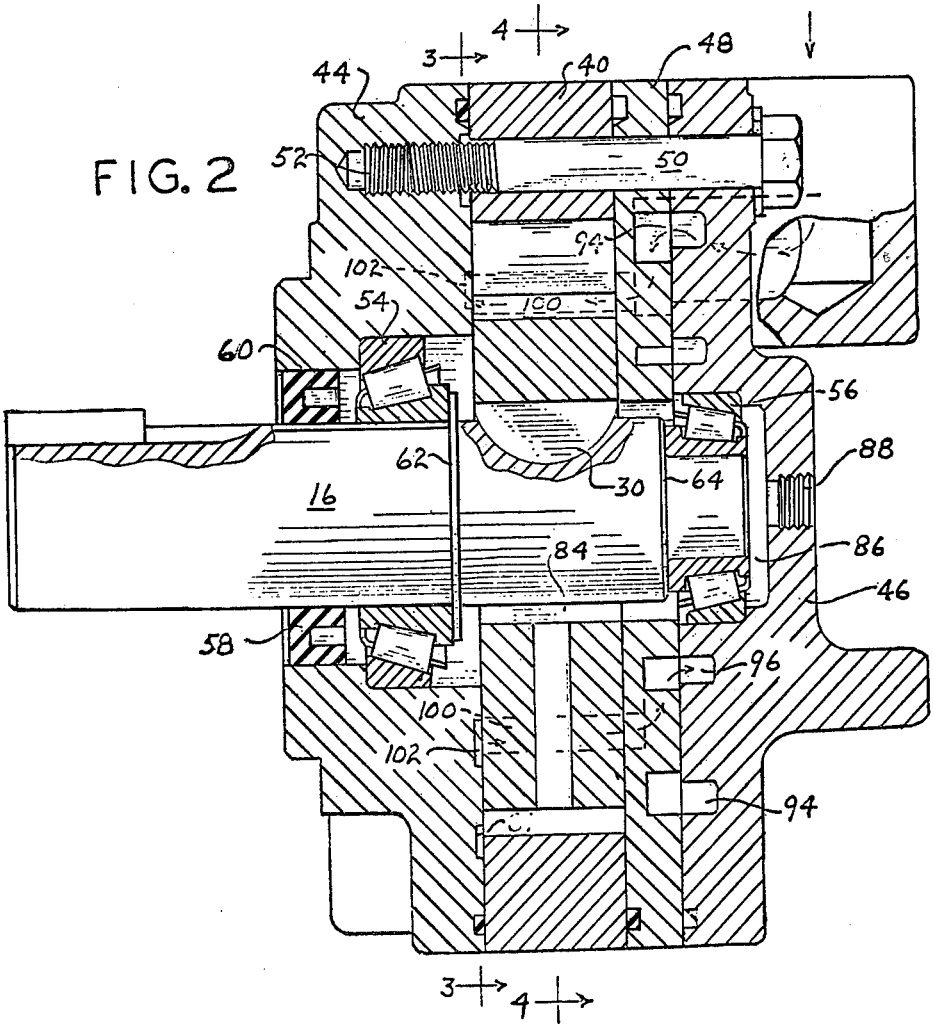
FIG. 2 is an enlarged cross-sectional view of the hydraulic motor shown in FIG. 1, the section being taken on line 2 — 2 of the latter figure.
Figure 4:
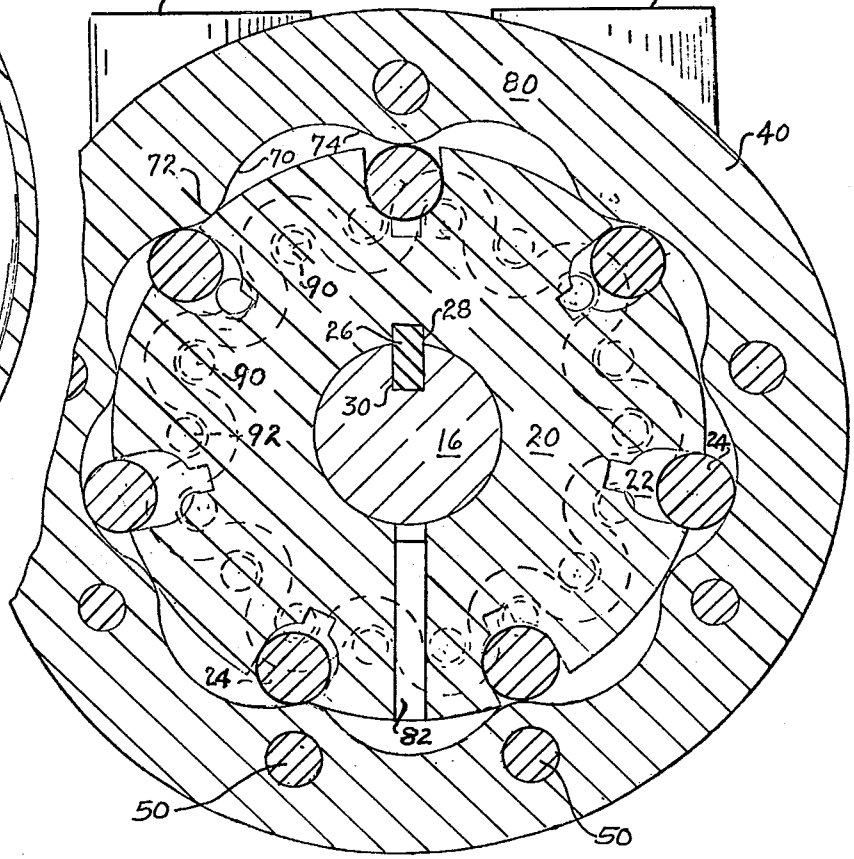
FIG. 4 is a cross-sectional view of the hydraulic motor, the section being taken on line 4 — 4 of FIG. 2.
Figure 3:
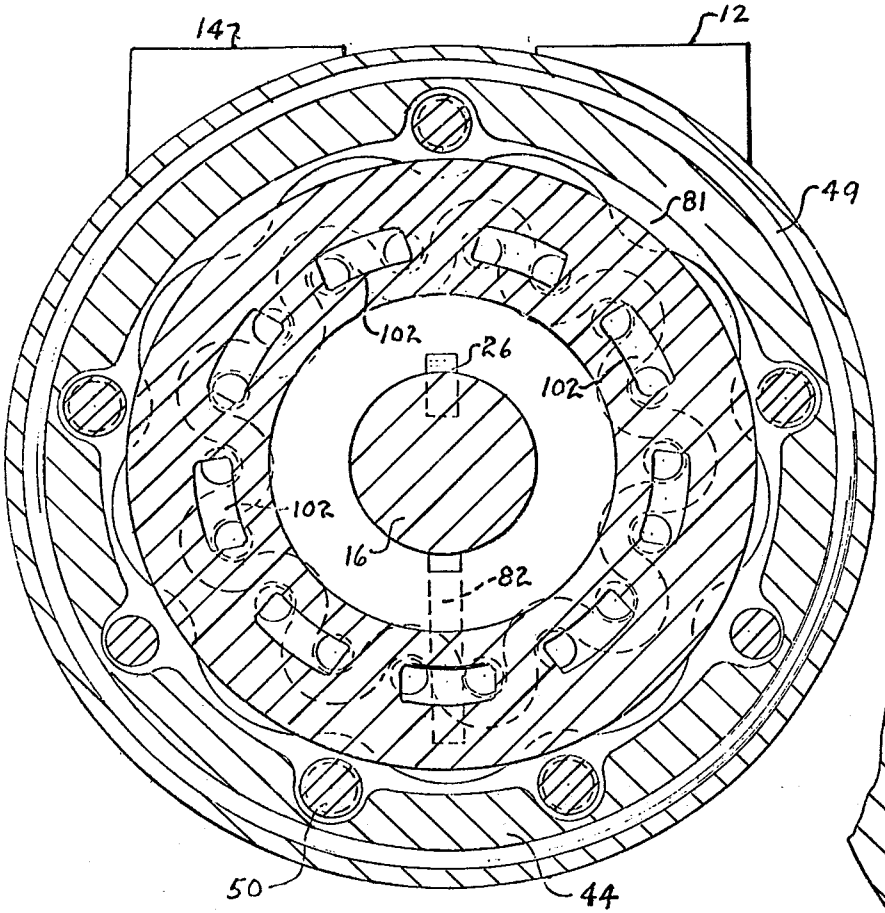
FIG. 3 is a transverse cross-sectional view of the hydraulic motor shown in the preceding figures, the section being taken on line 3 — 3 of FIG. 2.

The chambers 22 in rotor 20 consist of slots extending across the periphery of the rotor, and the rolling elements 24 form a relatively snug rotative fit in chambers 22 and are adapted to reciprocate therein from the internal end of the chamber, as viewed in the one at the top of FIG. 4, to their fully extended position as illustrated by the two cylinders in approximately the 4 and 8 o'clock positions as viewed in FIG. 4. The rolling elements are forced outwardly by the pressure in the chambers on the internal side of the elements 24 and the elements react against the increasing surfaces 70 of each lobe 72 on the cam surface of reaction member 40. When the pressure is relieved in chambers 22, the fluid is ejected therefrom through outlet 14 at a relatively low pressure, as the rolling elements 24 engage decreasing cam surfaces 74. The number of lobes 72 on the cam surface is different from the number of chambers and rolling elements, either greater or fewer in number, in order to maintain a uniform operation in the device. The rolling elements 24 are cylindrical in shape and are substantially the same length as the width of rotor 20 and form a relatively snug fit at the ends between sections 44 and 48, as seen in FIG. 2, thus eliminating or minimizing the flow of fluid from the inner end of chambers 22 to the spaces 80 between lobes 72, although some fluid may seep into the spaces 80, and a drain is provided therefor. The spaces are connected to one another by an annular passage 81 in the inner face of section 44. The fluid finding its way into spaces 80 is removed by a drain passage 82 extending inwardly to a transverse passage 84 adjacent shaft 16. This transverse passage communicates with a drain cavity 86 which is in turn drained by a conduit (not shown) connected to cavity 86 through threaded hole 88. Thus the fluid is not permitted to build up a back pressure in the spaces 80, which might otherwise react against the rolling elements and interfere with the proper operation of the motor.

Chambers 22 are alternately connected to the high pressure inlet 12 and low pressure outlet 14 by ports 90 and 92 in port plate or section 48, the ports 90 being connected by an annular groove 96 in section 46 with inlet port 12, and ports 92 being connected by annular groove 94 in section 46 with outlet port 14. When chambers 22 are communicating with ports 90, the rolling elements 24 are traversing outwardly extending inclines 70 of the cam surface on the stator, and when the chambers are in communication with ports 92, the rolling elements are traversing inwardly extending surfaces 74. The rolling elements are urged outwardly by the high pressure transmitted to the chamber from conduit 12 and ports 90, against the inclined surfaces 70, thus causing rotational movement of rotor 20. The inwardly inclined portions 74 return the rolling elements to the inner ends of chambers 22, causing the fluid in the chambers to be ejected through ports 92 and low pressure outlet 14. The rotor is hydraulically balanced by the transmittal of hydraulic fluid to the side of the rotor 20 opposite ports 90 and 92. These ports are connected by a passage 100 extending completely through the rotor to slots 102, which are shown as located in the surface of section 44, but which may be located in the respective side of the rotor. Passage 100 communicates directly with chambers 22 and transmits the pressure of either ports 90 or ports 92 to the opposite side of the rotor, and since slots 102 communicate with passage 100, the pressure of the fluid received from passage 100 is applied to the left hand side of the rotor as viewed in FIG. 2, i.e. to the side opposite the side on which the ports 90 and 92 are located. The slots 102 are positioned with respect to ports 90 and 92 in such a way as to vary the pressure in response to the varying communication of chambers 22 with one or the other of ports 90 or 92. Thus each of the slots 102 contains a fluid under a pressure representing the pressure being applied at the particular moment on the opposite side of the rotor.

In the operation of the present motor, with the motor being connected to a mechanism or other equipment to be driven thereby, the fluid is transmitted from a high pressure source to inlet 12. The high pressure fluid then passes through annular groove 96 and ports 90 into the chambers which are in communication with ports 90. These chambers contain the rolling elements in contact with the outwardly extending inclined portions 70 of the cam surface of the stator. The high pressure forcing the rolling elements outwardly causes the rotor to rotate in the clockwise direction, as viewed in FIG. 4. The chambers containing the rolling elements in contact with the inwardly extending inclined surfaces 74 are in communication with the ports 92, which in turn are in communication with groove 94 and outlet port 14. The movement of the rolling elements inwardly on inclined surfaces 74 ejects the low pressure fluid from chambers 22. As pointed out previously herein, in this embodiment, fewer chambers 22 and rolling elements 24 are provided in the rotor than lobes 72 on the stator, so that there is a constant and uniform rotational movement of the rotor with substantially constant pressure being applied at spaced points around the periphery thereof as the rolling elements react on inclined surfaces 70. As the rotor rotates, the pressure on opposite sides of the rotor is maintained substantially equal in the manner previously described herein, by the fluid transmitted through passage 100 to the slots 102. Thus the rotor is hydraulically balanced on all principal axes.

While only one embodiment has been described in detail herein, various changes and modifications may be made without departing from the scope of the invention.

I claim:

1. A hydraulic motor comprising an annular shaped stator defining a compartment and having an internal cam surface having a plurality of lobes forming alternate outwardly and inwardly extending reaction surfaces, a rotor concentrically mounted within said stator compartment and having a plurality of spaced fluid pressure chambers disposed around the periphery and extending from side-to-side of the rotor to provide the chambers with opposite open ends in the sides of the rotor, each chamber having a slot in the inner end extending to at least one end of said rotor and having two straight opposed wall portions extending parallel with the axis of the rotor and being parallel to one another, a rolling piston element of cylindrical shape on an axis parallel with the axis of the rotor between said wall portions in each of said chambers engaging by direct contact said outwardly extending surface for rotating said rotor and engaging said inwardly extending reaction surface for ejecting fluid from said chamber, only one piston element contacting a particular lobe at any given time, and the number of pistons being similar in number to but different from said lobes to substantially balance the radical forces on said rotor, a member disposed at one side of and in operative contact with said rotor and having alternate high and low pressure ports connected to said compartment and directly with an open end of said chamber slots at the side of the rotor and corresponding in number to the number of said lobes, the width of said slots of said chambers being substantially the same size as said ports in the circumferential direction of said rotor, a fluid inlet port connected to said high pressure ports, a fluid outlet port connected to said low pressure ports, and a power output shaft connected to said rotor.

2. A hydraulic motor as defined in claim 1 in which said rotor is mounted on a shaft concentrically located with respect to said cam surface.

3. A hydraulic motor as defined in claim 1 in which outwardly and inwardly extending reaction surfaces define nine inwardly extending lobes on said cam surface and in which said rotor has seven fluid pressure chambers around the periphery thereof.

4. A hydraulic motor as defined in claim 2 in which said rotor is mounted on a shaft axially located with respect to said cam surface.

5. A hydraulic motor as defined in claim 1 in which a wall section is disposed on one side of said stator and is provided with alternately high and low fluid pressure ports and a wall section is disposed on the other side of said stator.

6. A hydraulic motor as defined in claim 5 in which a wall section is disposed on the side of said rotor opposite said section having said ports and contains a plurality of slots for applying a pressure to said rotor substantially equal to the pressure applied to the opposite side of said rotor.

7. A hydraulic motor as defined in claim 5 in which means communicates pressure from said pressure ports to the opposite side of said rotor to hydraulically balance said rotor.

8. A hydraulic device comprising an annular shaped stator defining a compartment and having an internal cam surface having a plurality of lobes forming alternate inwardly and outwardly extending reaction surfaces, a rotor concentrically mounted within said stator compartment and having a plurality of spaced fluid pressure chambers disposed around the periphery thereof and extending from one side to the other to provide the chamber with opposite open ends in the sides of the rotor, each chamber having a slot in the inner end extending to at least one end of said rotor and having two straight opposed wall portions extending parallel with the axis of the rotor and being parallel to one another, a single roller piston element of cylindrical shape on an axis parallel with the axis of the rotor and co-extensive therewith between said wall portions in each of said chambers responding to fluid pressure in said chambers and engaging by direct contact alternately said inwardly and outwardly extending reaction surfaces, only one piston element contacting a particular lobe at any given time, and the number of pistons being similar in number to but different from said lobes to substantially balance the radial forces on said rotor, a member disposed at one side of and in operative contact with said rotor and having alternate high and low pressure ports connected to said compartment adjacent said chambers and communicating directly therewith at an open end of said chamber slots at the side of the rotor and corresponding in number to the number of said lobes, the width of said slots of said chambers being substantially the same size as said ports in the circumferential direction of said rotor, a fluid inlet passage connected to one of said alternate ports, and a fluid outlet passage connected to the other of said alternate ports, the number of pairs of said inwardly and outwardly extending reaction surfaces being different from the number of said fluid chambers in said rotor.

9. A hydraulic motor as defined in claim 8 in which means communicates pressure from said pressure ports to the opposite side of said rotor to hydraulically balance said rotor.

10. A hydraulic motor as defined in claim 8 in which a wall section is disposed on the side of said rotor opposite said section having said ports and contains a plurality of slots for copying a pressure to said rotor equal to the pressure applied to the opposite side of said rotor.

11. A hydraulic motor as defined in claim 8 in which said rotor is mounted on a shaft axially located with respect to said cam surface.

12. A hydraulic motor as defined in claim 8 in which outwardly and inwardly extending reaction surfaces define nine inwardly extending lobes on said cam surface and in which said rotor has seven fluid pressure chambers around the periphery thereof.

* * * * *